US007488881B2

(12) United States Patent
Kessler

(10) Patent No.: US 7,488,881 B2
(45) Date of Patent: Feb. 10, 2009

(54) MUSIC INSTRUMENT COVER

(76) Inventor: Daniel J. Kessler, 8529 Crestview Dr., Fairfax, VA (US) 22031

( * ) Notice: Subject to any disclaimer, the term of this patent is extended or adjusted under 35 U.S.C. 154(b) by 900 days.

(21) Appl. No.: 10/626,563

(22) Filed: Jul. 25, 2003

(65) Prior Publication Data

US 2005/0257664 A1 Nov. 24, 2005

Related U.S. Application Data

(60) Provisional application No. 60/398,350, filed on Jul. 25, 2002.

(51) Int. Cl.
*G10D 3/00* (2006.01)

(52) U.S. Cl. ..... 84/329

(58) Field of Classification Search ..... 84/453, 84/267, 274, 290, 329, 327; 150/162; 206/314
See application file for complete search history.

(56) References Cited

U.S. PATENT DOCUMENTS 3,877,501 A * 4/1975 Toth ..... 150/162
4,000,678 A 1/1977 Messina
4,177,847 A * 12/1979 Spindler ..... 150/162
4,185,534 A 1/1980 Cove
4,227,049 A 10/1980 Thomson et al.
D278,442 S 4/1985 Whomsley
D285,700 S 9/1986 White
4,977,808 A * 12/1990 Thacker ..... 84/291
D315,167 S 3/1991 Willis
D320,405 S 10/1991 Wyant
D322,717 S 12/1991 Wyant
5,517,891 A * 5/1996 Sica ..... 84/453
5,725,094 A 3/1998 Moral
5,763,796 A * 6/1998 Britto et al. ..... 84/95.2
6,410,834 B1 * 6/2002 Hearfield ..... 84/453
6,576,823 B1 * 6/2003 Wise, Jr. ..... 84/327

FOREIGN PATENT DOCUMENTS

JP 2003029742 A * 1/2003 ..... 84/291

* cited by examiner

*Primary Examiner*—Kimberly R Lockett
(74) *Attorney, Agent, or Firm*—Oliff & Berridge, PLC

(57) ABSTRACT

A protective instrument cover includes at least a front portion that extends over substantially an entire front surface of an instrument body of, for example, a guitar, and preferably also includes a side portion and a back portion that cover the side and back surfaces of the instrument, respectively. The cover is preferably made, at least partially, of stretchable material. A fastener such as a zipper attaches the cover to the instrument body. The cover preferably can be attached to the instrument body without requiring removal of hardware of the instrument body.

19 Claims, 2 Drawing Sheets

MUSIC INSTRUMENT COVER

This nonprovisional application claims the benefit of U.S. Provisional Application No. 60/398,350, filed Jul. 25, 2002.

BACKGROUND OF THE INVENTION

1. Field of Invention

The present invention relates to a well fit and flexible cover used to create or enhance an aesthetic effect of a music instrument while also protecting the instrument from scratches and dust.

2. Description of Related Art

Instruments such as electric guitars and electric basses are often manufactured with select few colors and little design. Currently there are few ways to change the look of these instruments without the use of paint or stickers.

U.S. Pat. No. 6,410,834 to Hearfield discloses a protective cover of leather for a stringed musical instrument. The cover includes front, back and side pieces that are attached to the instrument by one of various fastening means.

SUMMARY OF THE INVENTION

Some disadvantages of the cover disclosed in the above-mentioned patent are: (1) to install the cover on a guitar, the body hardware of the guitar (e.g., switches, knobs, bridge, tailpiece, carrier-strap fastenings, output jack) must first be removed, and then re-attached after the cover is attached to the guitar body; and (2) since the cover is made of leather, it is not stretchable and therefore must be cut very precisely prior to installation, particularly if a fastening means such as press-stud halves, a hook-and-loop fastener or a zipper is to be used. The first of these disadvantages results in more time consumption and inconvenience in installing or removing the cover, or in interchanging an installed cover with another cover. The second of these disadvantages results in increased manufacturing costs, due, e.g., to the increased care that must be taken to precisely cut out the cover pieces and the increased likelihood of error and waste.

It is an object of the current invention to overcome these disadvantages while providing a substantially full body jacket for a music instrument, without affecting the instrument's playability. All switches, buttons, knobs, and other devices are preferably left uncovered and freely accessible. The music instrument jacket may be attached to the instrument by one or more of various fasteners, such as a hook-and-loop fasteners, buttons, zippers, snaps, lacing or the like.

It is also an object of the present invention to protect the music instrument from dust and scratches while offering the musician the opportunity to select a design and/or material of his or her preference.

These and other objects, advantages and salient features of the invention are described in or apparent from the following detailed description of exemplary embodiments.

BRIEF DESCRIPTION OF THE DRAWINGS

The invention will be described with reference to the drawings, in which.

DETAILED DESCRIPTION OF PREFERRED EMBODIMENTS

The present invention relates to a protective cover especially adapted to protect at least a portion of a music instrument, e.g., the sound box and/or main body portion of a guitar, while changing its aesthetic effect. The cover fits closely to the music instrument's body so that the musician has full capability of playing the music instrument, unimpeded by the cover. The music instrument jacket may be easily and quickly attached to the instrument body, and remains securely attached during times of use of the music instrument.

Figure 1:
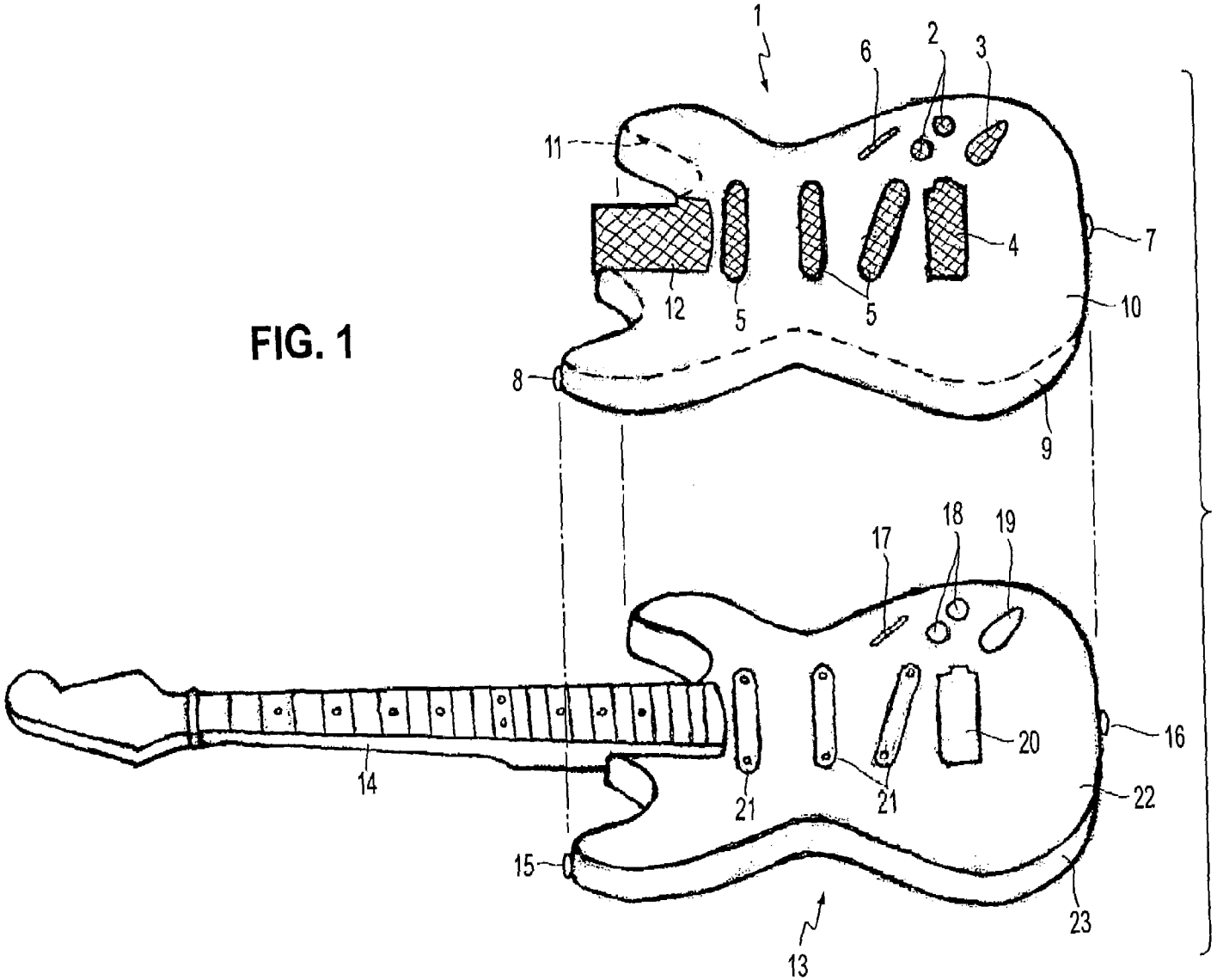
FIG. 1 is a top perspective view of a guitar equipped with an exemplary music instrument jacket according to this invention.
Figure 2:
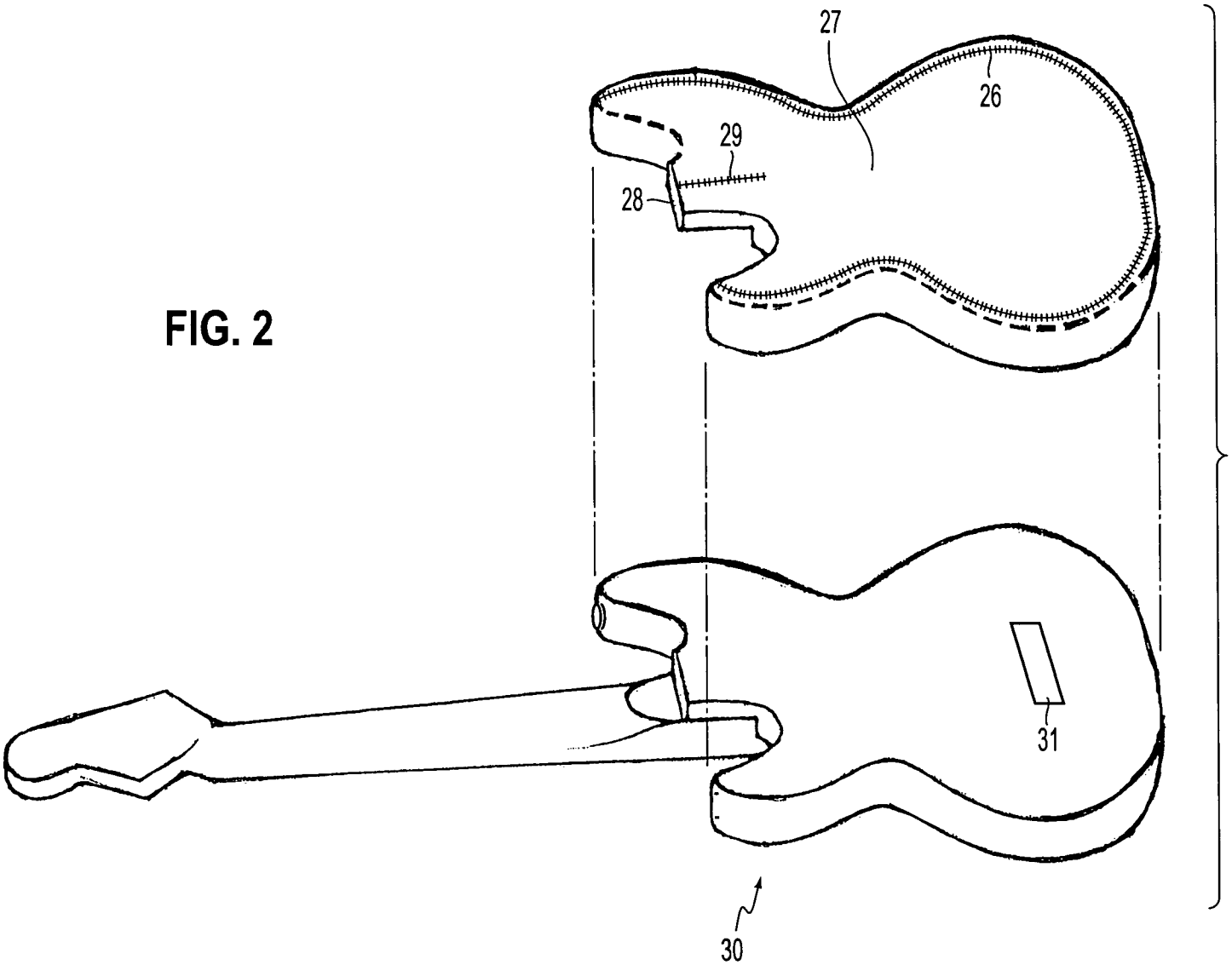
FIG. 2 is a bottom perspective view of the guitar and jacket of FIG. 1.

FIGS. 1-2 illustrate an exemplary music instrument jacket 1 adapted to fit an electric guitar 13. As shown in FIG. 1, control knob slits 2 in the cover 1 positionally correspond to a plurality of control knobs 18 on the guitar 13. A slit 3 in the cover 1 allows an electric wire to be plugged into a plug 19 on the guitar 13. A bridge slit 4 in the cover 1 positionally corresponds to a bridge 20 of the guitar 13. Pick-up slits 5 in the cover positionally correspond to electronic pick-up devices 21 of the guitar 13, and expose the electronic pick-up devices 21 so to not affect the sound of the instrument. Switch slit 6 in the cover 1 positionally corresponds to switch 17 of the guitar 13. Holes 7 and 8 in the cover 1 positionally correspond to knobs 15 and 16 that are provided on the guitar 3 for attachment of a carrying strap (not shown).

The cover 1 includes a side portion 9, a front portion 10 and a back portion 27 (see FIG. 2). The exact shape and size of the cover will, of course, depend upon the shape of the particular music instrument to which the cover is to be attached. As shown, the front portion 10 extends over substantially the entire front surface 22 of the guitar, the side portion 9 extends substantially over the entire side surface 23 of the guitar, and the back portion 27 extends substantially over the entire back surface of the guitar 13. If desired, openings may be provided in the front portion 10, the side portion 9 and/or the back portion 27 in the form of a decorative pattern. Thus, the portions of the cover 1 may extend substantially over the entire respective portions of the surfaces of the guitar 13, without necessarily covering the entire respective portions.

The cover 1 can be made from a single piece of material, e.g., cut, folded and stitched together at its matching edges, or it can be made from two or more pieces of material, e.g., stitched together at their edges.

The cover 1 is preferably made, at least partially, of a stretchable material, such as latex or a foamed polymeric material such as neoprene or spandex (such as LYCRA). When the cover 1 is made of more than one piece, different materials may be used for different pieces, if desired. Other materials such as leather, canvas or the like may be used, but are not as desirable because they do not stretch to fit around the music instrument body. (While leather and canvas may, in a strict sense, be considered to stretch to some degree, they do not noticeably stretch when subjected to a tensile force by hand. Thus, in the context of this application, "stretchable" shall mean "able to be stretched noticeably by hand.") The cover 1 may include both stretchable and non-stretchable portions. For example, the front may be made of leather and the back may be made of neoprene, or vice versa, or one or more non-stretchable panels may be included in front and/or back portions that are otherwise made of stretchable material.

Preferably, at least an upper edge 11 of the cover 1 is seamed in order to ensure a tight fit. A neck fitting portion 12 of the edge 11 fits around the neck 14 of the guitar 13 so as not to overlap any portion of the neck 14 (because overlapping the neck 14 could make the guitar un-playable).

In FIG. 2, numeral 30 indicates the back of the guitar 13. Fasteners such as an edge zipper 26 and/or a back zipper 29 fasten together the side portion 9 and the back portion 27 of the cover 1, thereby attaching the cover 1 to the guitar 13. If only the back zipper 29 is provided, it may be lengthened beyond what is depicted, if necessary, to allow the cover 1 to fit onto the body of the guitar 13. Other possible fasteners, other than zippers, include hook-and-loop fasteners (such as VELCRO) or other interlockable fasteners such as 3M™ Dual Lock™ fastener, snaps, buttons and lacing-threaded-through-eyelets-type fasteners.

To attach the depicted cover 1 to the guitar 13, the strings (not shown) are first removed from the guitar 13. The guitar neck 14 is then slid through an opening 28 in the cover 1. The cover 1 is then secured to the guitar 13 by zipping zippers 26 and/or 29 closed. The strings may then be re-attached to the guitar 13.

Preferably, none of the guitar hardware, e.g., the control knobs 18, the plug 19, the bridge 20, the electronic pick-up devices 21, the switch 17 or the knobs 15 and 16, needs to be removed in order to attach the depicted cover 1 to the guitar 13. (As used herein, the strings are not considered as part of the guitar hardware.) This may be accomplished by making the various slits and openings large enough to fit over the hardware. When stretchable material is used, various ones of the slits and openings may be slightly smaller than the hardware to which they correspond, because the openings can then stretch over or around the hardware. For example, the openings 2 can stretch over the control knobs 18. In embodiments, it is also acceptable to structure the cover 1 so as to require removal of some of the hardware or all of the hardware prior to attaching the cover 1 to the guitar 13.

Embodiments are also possible in which the cover 1 may be attached to the cover without removing the strings. Such a feature could be implemented by, for example, providing a zipper or other fastener in the front portion 10 of the cover, extending between the bridge slit 4 and the neck fitting portion 12 of the edge 11. Such a fastener could replace or be provided in addition to the edge zipper 26 and/or the back zipper 29, and would allow the cover 1 to be attached to the guitar 13 without removing the strings.

As shown in FIG. 2, the guitar 13 includes a hole 31 formed in its back. The cover 1 may be structured to cover the hole 31 if desired, since covering the hole 31 typically doesn't significantly affect playing or performance of the instrument.

While the invention has been described in conjunction with the specific embodiments described above, many equivalent alternatives, modifications and variations may become apparent to those skilled in the art when given this disclosure. Accordingly, the exemplary embodiments of the invention as set forth above are considered to be illustrative and not limiting. Various changes to the described embodiments may be made without departing from the spirit and scope of the invention.

For example, while the foregoing description specifically describes an electric guitar, the invention may also be applied to other types of guitars, such as acoustic guitars, or even to other instruments such as violins, cellos, bass guitars, and so forth.

What is claimed is:

1. A protective instrument cover, comprising:

a front portion that extends over substantially an entire front surface of a stringed instrument body and is between (a) the stringed instrument body and (b) a string of the stringed instrument body; and means for attaching the front portion to the front surface of the stringed instrument body without requiring removal of hardware of the stringed instrument body, the means for attaching comprising one or more of a hook-and-loop fastener, a button, a zipper, a snap, or lacing.

2. The protective instrument cover of claim 1, wherein at least part of the cover comprises stretchable synthetic material.

3. The protective instrument cover of claim 2, wherein the stretchable synthetic material comprises neoprene.

4. The protective instrument cover of claim 2, wherein the stretchable synthetic material comprises spandex.

5. The protective instrument cover of claim 2, wherein the stretchable synthetic material comprises latex.

6. The protective instrument cover of claim 1, wherein the stringed instrument is a guitar.

7. The protective instrument cover of claim 1, wherein the means for attaching comprises at least one zipper.

8. A protective instrument cover, comprising:

a front portion that extends over substantially an entire front surface of a stringed instrument body and is between (a) the stringed instrument body and (b) a string of the stringed instrument body; and a fastener that attaches the front portion of the cover to the front surface of the stringed instrument body, wherein at least part of the cover comprises stretchable synthetic material.

9. The protective instrument cover of claim 8, wherein the stretchable synthetic material comprises neoprene.

10. The protective instrument cover of claim 8, wherein the stretchable synthetic material comprises spandex.

11. The protective instrument cover of claim 8, wherein the stretchable synthetic material comprises latex.

12. The protective instrument cover of claim 8, wherein the stringed instrument is a guitar.

13. The protective instrument cover of claim 8, wherein the fastener comprises at least one zipper.

14. A protective instrument cover, comprising:

a front portion that extends over substantially an entire front surface of an instrument;

a back portion that covers at least part of a back surface of the instrument body;

a side portion connecting the front portion and the back portion; and means for attaching the front portion, back portion and side portion to the instrument body without requiring removal of hardware of the instrument body;

wherein at least one of the front portion, the back portion or the side portion comprises stretchable synthetic material; and wherein the means for attaching is functionally independent of a stretching action of the stretchable synthetic material.

15. The protective instrument cover of claim 1, wherein the front portion extends to an outer peripheral edge of the front surface of the stringed instrument body.

16. The protective instrument cover of claim 6, wherein the front portion extends to an outer peripheral edge of the front surface of the guitar.

17. The protective instrument cover of claim 8, further comprising a side portion that extends across a side surface of the stringed instrument body.

18. The protective instrument cover of claim 1, further comprising a side portion that extends across a side surface of the stringed instrument body.

19. The protective instrument cover of claim 1, wherein the front portion is stretchable.

* * * * *